US010695660B2

(12) United States Patent
Muraki et al.

(10) Patent No.: US 10,695,660 B2
(45) Date of Patent: Jun. 30, 2020

(54) TOY TOP

(71) Applicant: TOMY COMPANY, LTD., Tokyo (JP)

(72) Inventors: Makoto Muraki, Tokyo (JP); Rena Mase, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/892,676

(22) Filed: Feb. 9, 2018

(65) Prior Publication Data

US 2018/0229110 A1 Aug. 16, 2018

(30) Foreign Application Priority Data

Feb. 10, 2017 (JP) ..... 2017-022812

(51) Int. Cl.

| | |
|---|---|
| ***A63F 9/16*** | (2006.01) |
| ***A63F 3/00*** | (2006.01) |
| ***A63H 1/02*** | (2006.01) |
| ***A63H 1/04*** | (2006.01) |
| ***A63H 1/00*** | (2019.01) |

(52) U.S. Cl.

CPC ..... *A63F 9/16* (2013.01); *A63F 3/00895* (2013.01); *A63H 1/00* (2013.01); *A63H 1/02* (2013.01); *A63H 1/04* (2013.01)

(58) Field of Classification Search

CPC ..... A63H 1/00; A63H 1/04

See application file for complete search history.

(56) References Cited

U.S. PATENT DOCUMENTS

| | | | | |
|---|---|---|---|---|
| 4,655,723 | A * | 4/1987 | Marason, Jr. | A63H 33/00 411/385 |
| 4,772,241 | A * | 9/1988 | Bro | A63H 1/08 446/202 |
| 6,530,817 | B1 * | 3/2003 | Winslow | A63H 1/00 446/256 |
| 6,769,953 | B1 * | 8/2004 | Sutton | A63H 1/02 446/256 |
| 8,622,853 | B1 * | 1/2014 | Roland | A63B 69/3623 473/398 |
| 9,101,845 | B2 * | 8/2015 | Cai | A63H 1/18 |
| 9,597,604 | B1 * | 3/2017 | Horikoshi | A63H 1/02 |
| 10,080,975 | B2 * | 9/2018 | Choi | A63H 1/04 |

(Continued)

FOREIGN PATENT DOCUMENTS

| | | |
|---|---|---|
| CN | 2865812 Y | 2/2007 |
| CN | 2910307 Y | 6/2007 |

(Continued)

OTHER PUBLICATIONS

Espacenet English abstract for Chinese Patent Publication No. 2910307Y, published Jun. 13, 2007.

(Continued)

*Primary Examiner* — Eugene L Kim
*Assistant Examiner* — Christopher Glenn
(74) *Attorney, Agent, or Firm* — Staas & Halsey LLP

(57) ABSTRACT

A toy top includes a body portion having a component movably connected to an outer peripheral portion thereof. The component is movable within a predetermined range along a circumferential direction of the body around a rotational center of the toy top.

22 Claims, 7 Drawing Sheets

(56) References Cited

U.S. PATENT DOCUMENTS

| | | | | |
|---|---|---|---|---|
| 2002/0102907 | A1* | 8/2002 | Osawa | A63H 1/00 446/256 |
| 2009/0253344 | A1* | 10/2009 | Ujita | A63H 1/02 446/256 |
| 2010/0038852 | A1* | 2/2010 | Ishihara | A63F 3/00 273/236 |
| 2010/0159798 | A1* | 6/2010 | Bertrand | A63H 1/02 446/259 |
| 2012/0088433 | A1* | 4/2012 | Choe | A63H 1/02 446/256 |
| 2016/0175721 | A1* | 6/2016 | Choi | A63H 1/04 446/259 |
| 2016/0325190 | A1* | 11/2016 | Muraki | A63H 1/02 |

FOREIGN PATENT DOCUMENTS

| | | |
|---|---|---|
| CN | 200977395 Y | 11/2007 |
| CN | 200995064 Y | 12/2007 |
| CN | 201565124 U | 9/2010 |
| JP | 3151700 | 7/2009 |

OTHER PUBLICATIONS

Espacenet English abstract for Chinese Patent Publication No. 201565124 U, published Sep. 1, 2010.

Espacenet English abstract for Chinese Patent Publication No. 2865812Y, published Feb. 7, 2007.

Espacenet English abstract for Chinese Patent Publication No. 200977395Y, published Nov. 21, 2007.

Espacenet English abstract for Chinese Patent Publication No. 200995064Y, published Dec. 26, 2007.

European Office Action dated Sep. 13, 2018 in Application No. 18155976.6.

Office Action for Japanese Patent Application No. 2017-022812, dated Sep. 12, 2017.

* cited by examiner

TOY TOP

BACKGROUND OF THE INVENTION

1. Field of the Invention

The present invention relates to a toy top.

2. Description of Related Art

The structure of a toy top known in the art is such that a body having a function of attacking an opponent toy top is provided above an axis defining the rotational movement of the toy top (e.g. see Japanese Utility Model Registration No. 3151700).

Unfortunately, the toy top described in Japanese Utility Model Registration No. 3151700 has a simple attacking mode in which the body just collides with an opponent toy top. a problem with this conventional toy top is that it is not amusing enough.

SUMMARY OF THE INVENTION

The present invention has been made in view of the above-described problem, and an object thereof is to provide a toy top that has a more amusing attacking mode.

According to an aspect of the present invention, there is provided a toy top including:

a body; and a shaft portion, wherein the body includes a moving component in an outer peripheral portion, the moving component being movable within a predetermined range along a circumferential direction around a rotational center of the toy top.

Preferably, the body includes a projection protruding from an outer peripheral face, and the moving component is attached to the projection.

Preferably, the moving component is attached to the projection such that, when the moving component is placed at an end opposite to a rotational direction of the toy top of a movable range of the moving component, an end in the rotational direction of the moving component is placed at a side opposite to a rotational direction relative to an end in a rotational direction of the projection.

Preferably, the moving component is attached to the body with a separate fastener.

Preferably, the moving component is disposed on the body so as to protrude closer to an outer periphery than the body.

During the rotation of the toy top (before a collision with an opponent toy top), the moving component is disposed on an end opposite to a rotational direction within its movable range in the body. When the body collides with the opponent toy top, the moving component moves in the rotational direction and comes in contact with the body.

This operation can launch a two-step attack to the opponent toy top by a first impact force caused by a collision of the body, and a second impact force caused by a direct collision against the opponent toy top or indirectly caused by a contact of the moving component to the body when the moving component relatively moves in the rotational direction. The second step of the attack can be expected to be more powerful due to the relative movement of the moving component.

The toy top that has a more amusing attacking mode thus can be achieved.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION

Hereinafter, embodiments of the present invention will be described with reference to the drawings. Though various technical limitations which are preferable to perform the present invention are included in the after-mentioned embodiments, the scope of the invention is not limited to the following embodiments and the illustrated examples.

Figure 1A:
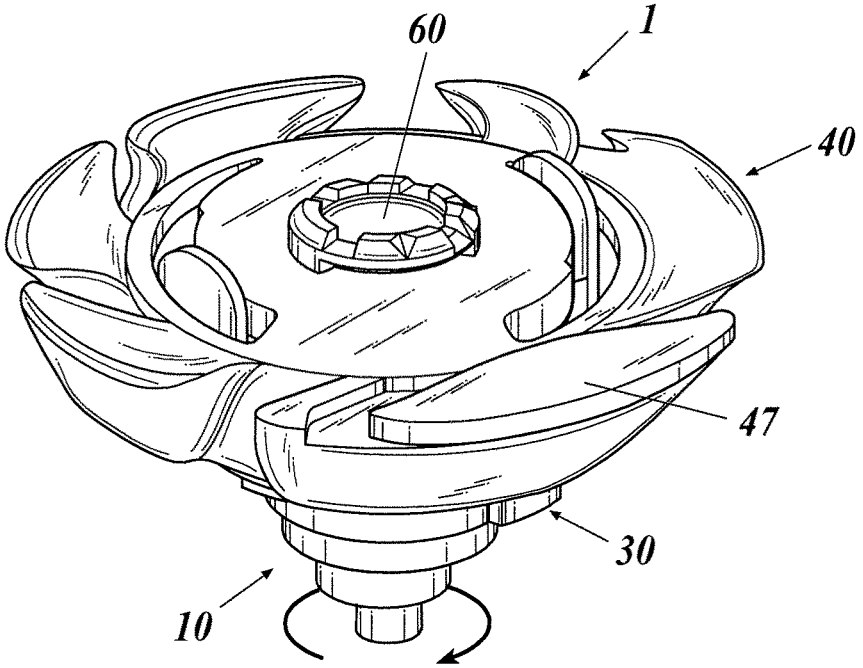
FIG. 1A is a perspective view of a toy top according to one embodiment of the present invention.
Figure 1B:
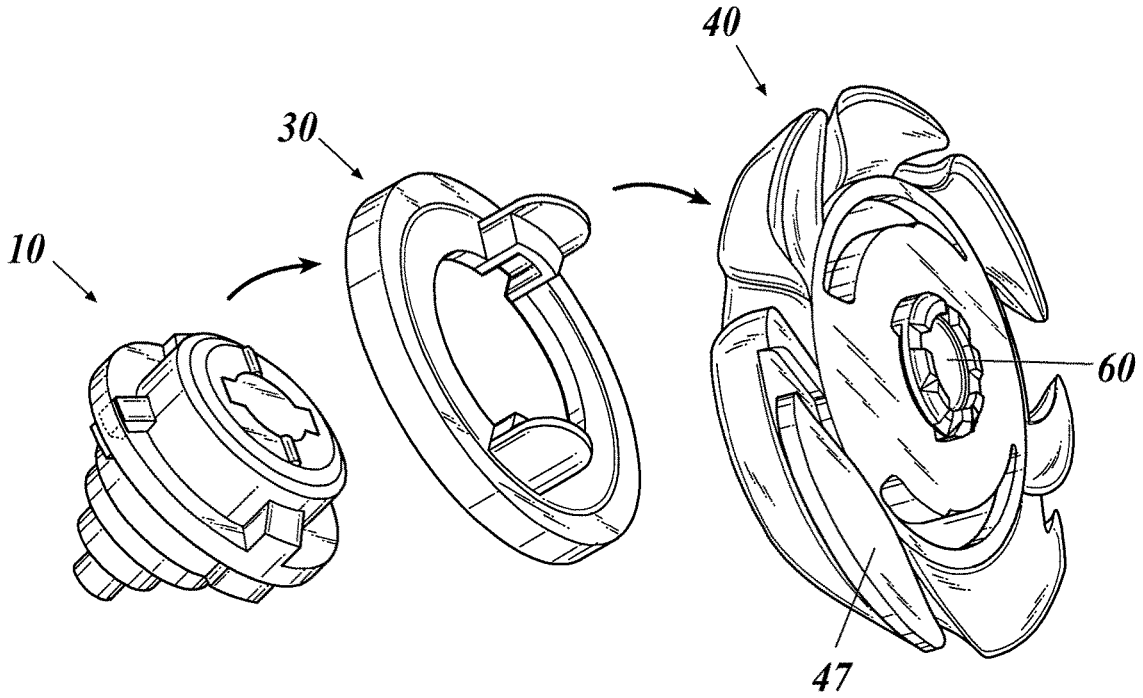
FIG. 1B illustrates how to play with a toy top according to an embodiment of the present invention.
Figure 2:
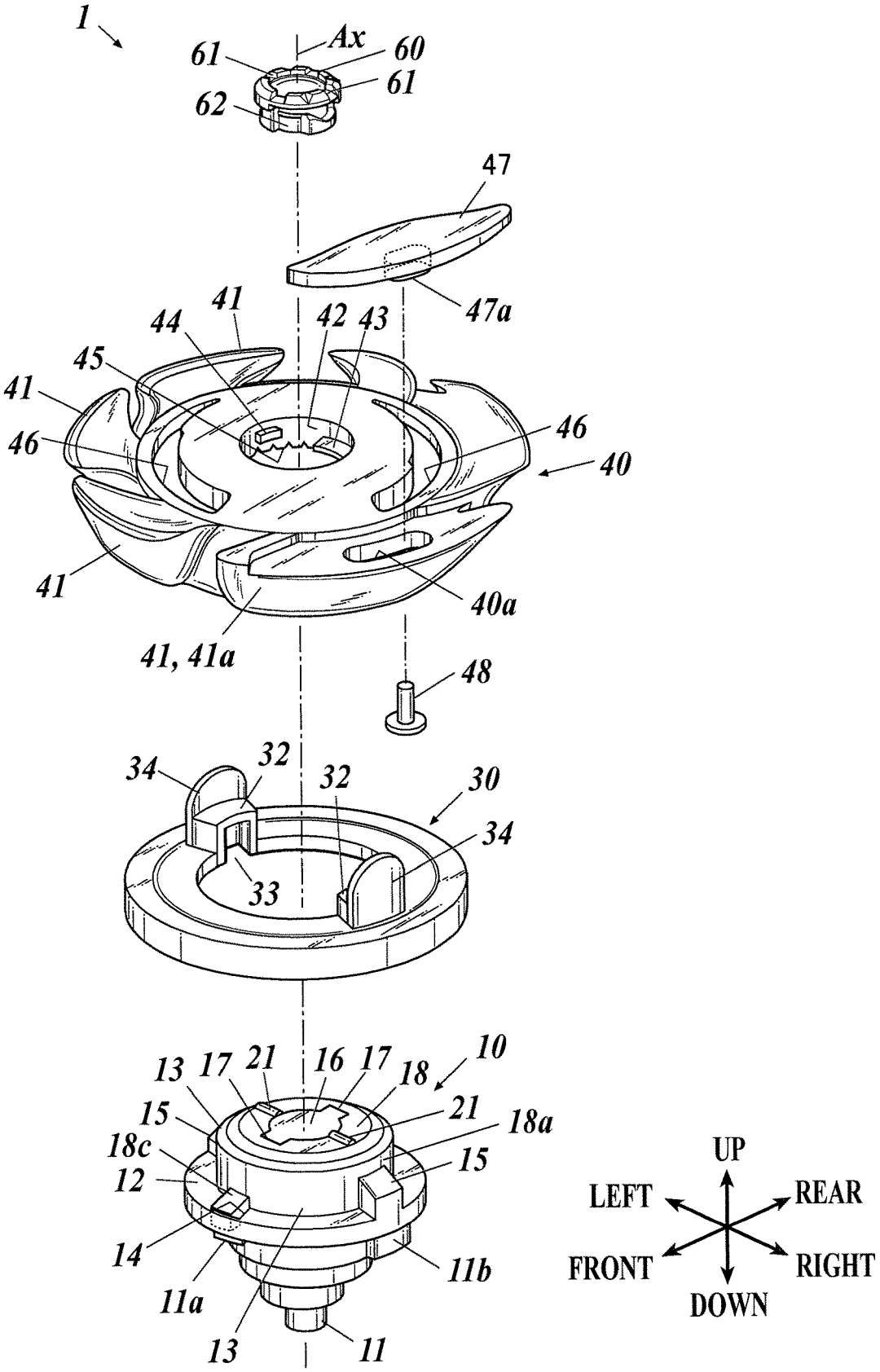
FIG. 2 is an exploded perspective view of the toy top according to the embodiment.

FIG. 1A is a perspective view of a toy top according to an embodiment of the present invention. FIG. 1B illustrates how to play with the toy top. FIG. 2 is an exploded perspective view of the toy top 1 according to the embodiment. As used herein, the terms up-down, right-left and front-rear represent the respective directions as illustrated in FIG. 2.

As shown in FIG. 1A, the toy top 1 of the embodiment is of a type that can be used in a so-called "top battle game". Specifically, the toy top 1 can be used in a battle game in which a player wins the game when an opponent toy top 1 is disassembled as illustrated in FIG. 1B by the impact force of a collision between toy tops.

As illustrated in FIG. 2, the toy top 1 is composed of a shaft portion 10, as a lower structure, and a performance changing ring 30 and a body 40, which are layered to form an upper structure.

1. Shaft Portion 10

As shown in FIG. 2, the shaft portion 10 includes a spinning shaft 11 in a lower part, a flange 12 in a middle part in the up-down (vertical) direction and a cylinder 13 in an upper part.

Among the above, the flange 12 and the cylinder 13 are integrated to constitute an upper section of the shaft portion 10. The flange 12 and the cylinder 13 may be fixed to a lower section of the shaft portion 10 with screws (not shown).

The lower section of the shaft portion 10 has a shape where its diameter decreases stepwise from the flange 12 toward a tip of the spinning shaft 11 and the lower section has a substantially reversed cone shape as a whole.

In the flange 12 and the cylinder 13, two holes 14 are formed which are mutually opposed in the front-rear direction across the axis Ax of the spinning shaft 11 which coincides with the vertical axis of the entire toy top 1 (hereinafter referred to simply as the "axis Ax"). On the other hand, protruding pieces 11*a* that protrude outward in the radial direction are provided at the lower section of the shaft portion 10 at positions corresponding to the holes 14 of the flange 12. The protruding pieces 11*a* are disposed below the holes 14 of the flange 12. Upper faces of the protruding pieces 11*a* form seat portions (described later).

Furthermore, on the cylinder 13, two protrusions 15 are formed at respective positions facing each other in the left-right direction across the axis Ax therebetween. Outer surfaces of the protrusions 15 are flush with an outer peripheral face of the flange 12. Furthermore, at the lower section of the shaft portion 10, protrusions 11*b* which protrude outward in a radial direction are formed at positions corresponding to the protrusions 15. At the portions corresponding to the protrusions 15 and 11*b*, the flange 12 and the cylinder 13 can be fixed to the lower section of the shaft portion 10 with screws (not shown).

Furthermore, a cylindrical pillar 16 stands inside the cylinder 13 (only an upper face is shown in FIG. 2). A base end of the cylindrical pillar 16 is coupled with the lower section of the shaft portion 10. An upper end of the cylindrical pillar 16 is set to be higher than the upper end of the cylinder 13 although such positioning is not essential. At the upper end of the cylindrical pillar 16, two hooks 17 that protrude outward in the radial direction are formed at the respective positions facing each other in the front-rear direction across the axis Ax therebetween.

The shaft portion 10 further includes a cylindrical pressing member 18. The pressing member 18 can be made, e.g., of synthetic resin or metal. The pressing member 18 is provided inside the cylinder 13 so as to surround an outer circumference of the cylindrical pillar 16.

Figure 3:
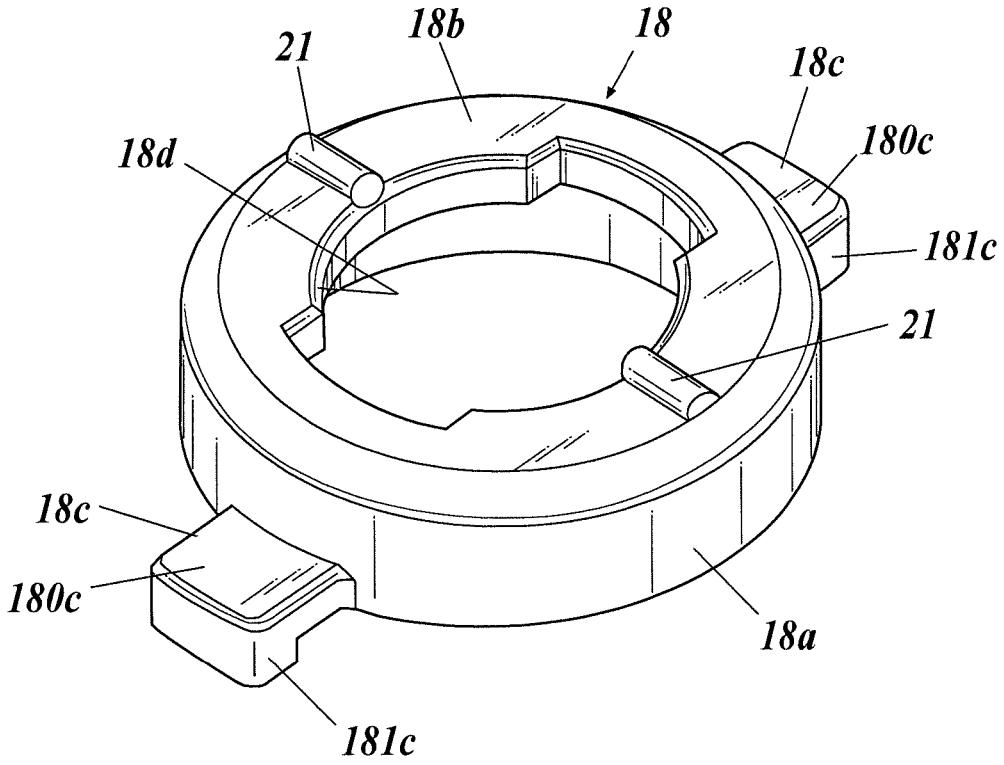
FIG. 3 is a perspective view of a pressing member according to the embodiment.

As shown in FIG. 3, the pressing member 18 includes a cylinder portion 18*a*, a ceiling 18*b* and legs 18*c*.

The ceiling 18*b* is provided at an upper end of the cylinder portion 18*a*. The ceiling 18*b* has a hole 18*d* that has a shape corresponding to the upper end portion of the cylindrical pillar 16.

Furthermore, the legs 18*c* are formed at the lower end portion on the outer periphery of the cylinder portion 18*a*. Two legs 18*c* are formed at the respective positions facing each other in the front-rear direction across the axis Ax therebetween. Each of the legs 18*c* has a horizontal portion 180*c* which protrudes horizontally from the cylinder portion 18*a* and a vertical portion 181*c* which extends downward in the vertical direction from a tip of the horizontal portion 180*c*.

The pressing member 18 having the above configuration is provided such that the legs 18*c* are inserted in the holes 14 as shown in FIG. 2. The sizes of the holes 14 in the up-down (vertical) direction are larger than the length of the legs 18*c*. Furthermore, the pressing member 18 is biased upward by a spring (not shown). With respect to the pressing member 18, the legs 18*c* are restricted from upward moving at upper edges of the holes 14 and, in the normal state, the upper end of the pressing member 18 is at the same height as the upper end of the cylinder 13.

On the upper face of the ceiling 18*b* of the pressing member 18, two ridges (protrusions) 21 which extend in the radial direction are formed at the respective positions facing each other in the left-right direction across the axis Ax therebetween.

2. Performance Changing Ring 30

In the embodiment, the performance changing ring 30 is a flywheel. The performance changing ring 30 has a substantially ring plate shape. On the bottom face of the performance changing ring 30, an annular step (not shown) is formed at an inner periphery which can hold the flange 12 of the shaft portion 10 from the lower side. Furthermore, on an upper face of the performance changing ring 30, two protrusions 32 are formed which are mutually opposed in the right-left direction across the axis Ax and protrude upward. On lower parts of the protrusions 32, recesses 33 are formed which can hold the respective protrusions 15 of the shaft portion 10 from a lower side. Furthermore, on an upper face of the performance changing ring 30, tongues 34 are formed which extend upward just along an outer side of the respective protrusions 32. The tongues 34 protrude higher than the protrusions 32. Alternatively, the performance changing ring 30 may be a ring with a protrusion on the outer peripheral face for facilitating an attack on an opponent toy top or a recess on the outer peripheral face for averting an attack from the opponent toy top instead of the flywheel or integrated with the flywheel.

3. Body 40

The body 40 has a substantially disk shape having the central axis along the axis Ax. A plurality of unequally spaced projections 41 protrudes from an outer peripheral face of the body 40. Each of the projections 41 has a shape that has a sharply angled tip in the clockwise direction in plan view. One projection 41*a* among the projections 41 is a portion to which a moving component 47 (described below) is attached. A top face portion other than a clockwise edge of the projection 41*a* in plan view is disposed lower than the other projections 41 by the thickness of the moving component 47. The projection 41*a* has a long hole 40*a* along the circumferential direction for attachment of the moving component 47. The long hole 40*a* extends over a predetermined range of angle (central angle around the axis Ax) and has two opposing, peripheral end faces 40*a*' and 40*a*".

The center of the body 40 has a round hole 42, a central axis of which is along the axis Ax. At a lower end of an inner peripheral face of the round hole 42, two hooks 43 protrude radially inward, which are opposed to each other across the axis Ax. At a middle part in the up-down (vertical) direction of the inner peripheral face of the round hole 42, two protrusions 44 protrude radially inward, which are opposed to each other across the axis Ax.

In a central portion adjacent to the round hole 42 of the lower end face of the body 40, two continuously uneven portions 45 are mutually opposed in the right-left direction across the axis Ax and mesh with the ridges 21 of the shaft portion 10.

The body 40 has two arc slits 46 mutually opposed across the round hole 42. Tongue 34 of the performance changing ring 30 can be inserted into the arc slits 46 from the lower side. Each of the arc slits 46 has a circumferential length that allows the tongues 34 to move therein.

The outer peripheral portion of the body 40 is provided with the moving component 47 movable along the circumferential direction around the axis Ax.

The moving component 47 may have a shape of a substantially circular arc plate. A curvature of an outer periphery of the moving component 47 substantially corresponds to that of the body 40. A boss 47*a* is on the bottom face of the moving component 47. A rivet 48 is fastened to the boss 47*a* to hold the moving component 47 on the body 40, with the boss 47*a* inserted from the upper side into the long hole 40*a*. The long hole 40*a* is formed in the projection 41*a* along the outer periphery of the body 40. In this case, the outer peripheral face of the moving component 47 is substantially flush with that of the body 40, or disposed on a slightly inner periphery.

Figure 6A:
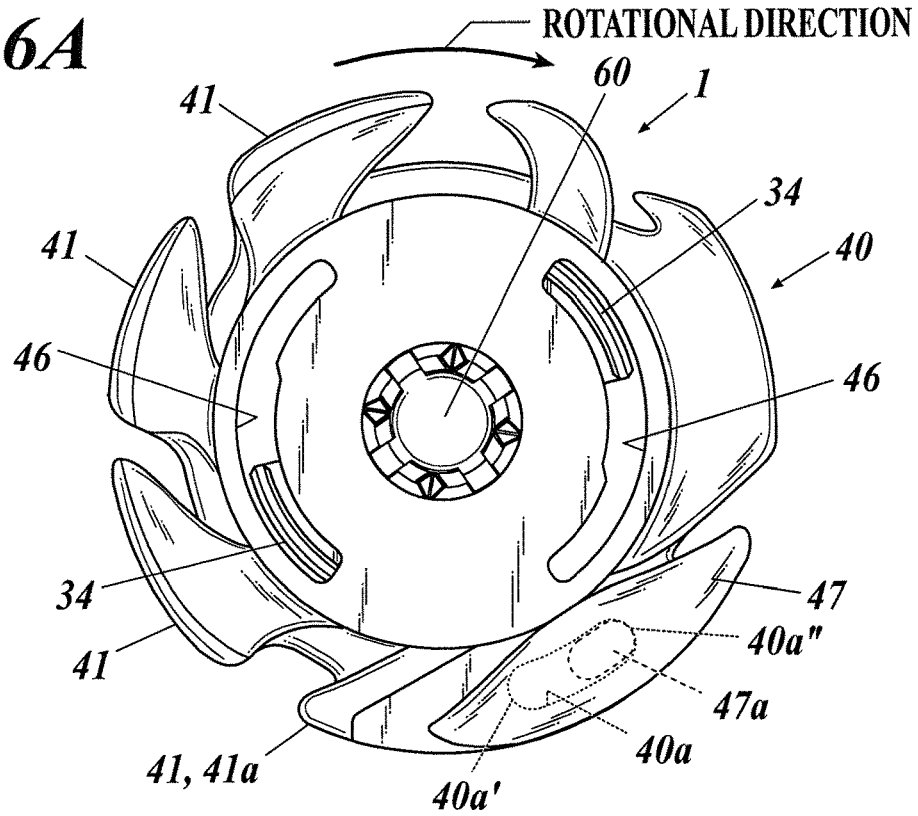
FIG. 6A and FIG. 6B illustrate an operation of a moving component according to the embodiment.
Figure 6B:
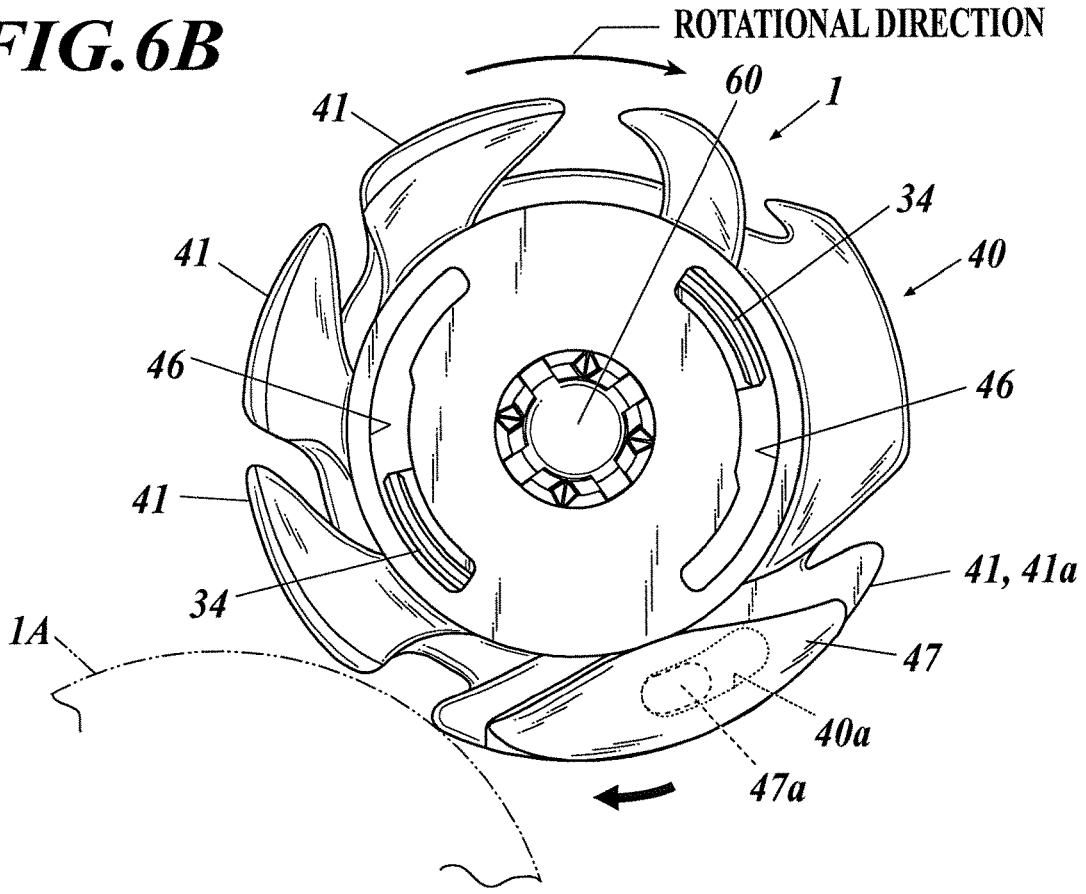

In such a configuration, the moving component 47 is attached to the body 40 so as to move freely along the circumferential direction around the axis Ax within an angular range (see FIGS. 6A and 6B). In the angular range, the boss 47*a* comes in contact with the two peripheral end faces 40*a*', 40*a*" of the long hole 40*a*. Alternatively, the movement of the moving component 47 may be restricted at the clockwise side in plan view not by a contact of the boss 47*a* with the inner peripheral face 40*a*" of the long hole 40*a*, but by a contact between the moving component 47 and the projection 41*a* of the body 40 at their respective clockwise ends in plan view.

An identifier 60 is attached in the round hole 42 of the body 40. The identifier 60 is used to identify the toy top 1 or the player thereof.

To achieve the identification, e.g., identifiers 60 with different patterns and/or colors are prepared, and one identifier selected therefrom by the player is attached to the round hole 42.

The identifier 60 has a substantially short cylindrical shape as a whole. The identifier 60 has an inverted conical recess in the center of the top surface. In a rim that surrounds the recess, two operation recesses 61 are formed which are mutually opposed across the axis Ax.

The identifier 60 has an outer periphery having two grooves 62 mutually opposed across the axis thereof. When the identifier 60 is inserted in the round hole 42 of the body 40, the protrusions 44 are fit in the grooves 62. Each of the grooves 62 includes a first portion that extends in the up-down (vertical) direction and is open in a bottom side of the identifier 60 and a second portion that extends in substantially a circumferential direction from an upper end of the first portion mentioned first. The identifier 60 is inserted into the round hole 42 of the body 40 from the upper side and then is turned such that the protrusions 44 of the round hole 42 fit in the grooves 62. The identifier 60 can be thereby attached to the round hole 42 of the body 40.

Assembling Method

An example of an assembling method of the toy top 1 will now be described.

Figure 4A:
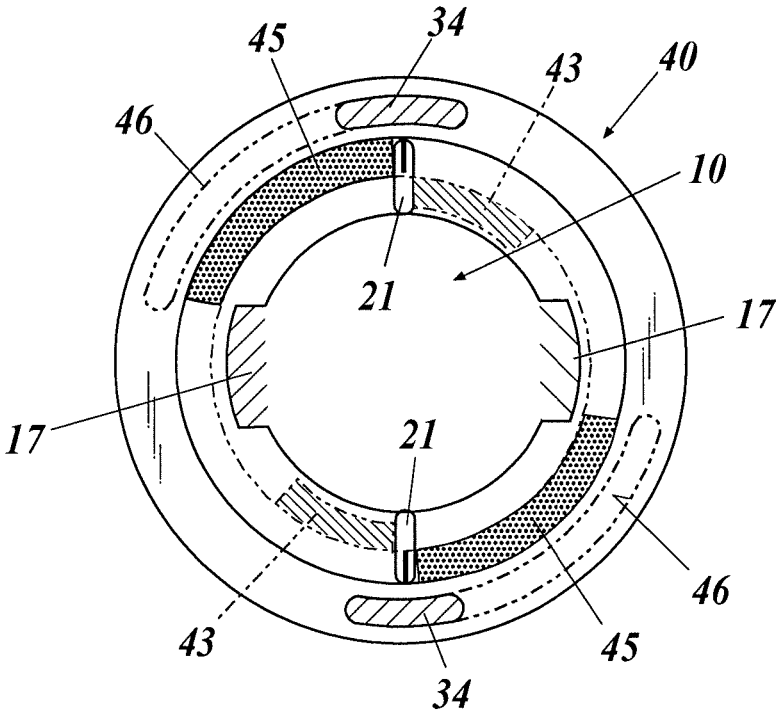
FIG. 4A and FIG. 4B illustrate an engagement condition among a shaft portion, a performance changing ring, and a body in the toy top according to the embodiment.
Figure 4B:
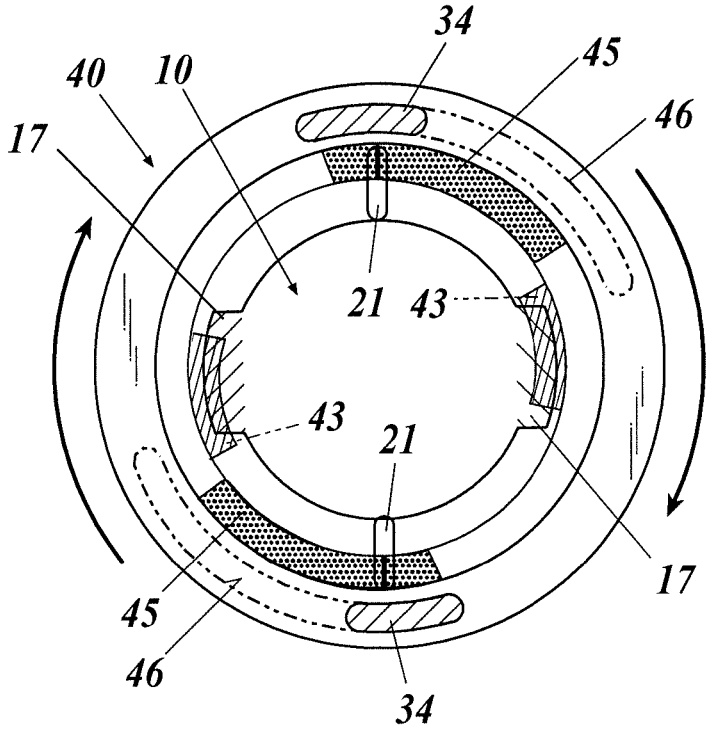

FIGS. 4A and 4B illustrate an engagement condition of the shaft portion 10, the performance changing ring 30, and the body 40.

The shaft portion 10 has been already assembled in this example. Furthermore, the identifier 60 has been already attached in the round hole 42 of the body 40.

The shaft portion 10 is fitted in the performance changing ring 30 from the lower side such that the protrusions 15 of the shaft portion 10 mate with the recesses 33 of the performance changing ring 30. The assembly is then brought from the lower side toward the body 40.

As shown in FIG. 4A, the tongues 34 of the performance changing ring 30 are disposed at predetermined ends of the arc slit 46 of the body 40. In this state, the hooks 17 of the shaft portion 10 do not yet overlap the hooks 43 of the body 40 in the vertical direction. This state is referred to as a decoupled state.

The shaft portion 10 of the assembly is pushed toward the body 40. The performance changing ring 30 is pushed against the lower surface of the body 40. The spring (not shown) in the shaft portion 10 then contracts and the hooks 17 of the shaft portion 10 are moved into position above the hooks 43 of the body 40.

As shown in FIG. 4B, the shaft portion 10, together with the performance changing ring 30, is then turned relative to the body 40 until the tongues 34 reach an end opposite to the predetermined end. This turn is a relative turn between the body 40 and the assembly of the performance changing ring 30 and the shaft portion 10.

FIG. 4B illustrates a state of the body 40 that turned relative to the performance changing ring 30 and the shaft portion 10 from the state of FIG. 4A. The hooks 17 of the shaft portion 10 are aligned with the hooks 43 of the body 40 in the vertical direction. When the shaft portion 10 is released, the lower face of the hooks 17 of the shaft portion 10 abuts the upper face of the hooks 43 of the body 40 due to the action of the biasing force of the spring (not shown) in the shaft portion 10.

The state where the lower faces of the hooks 17 of the shaft portion 10 and the upper faces of the hooks 43 of the body 40 abut is the coupled state. In such way, the shaft portion 10, the performance changing ring 30 and the body 40 are removably coupled with one another. The toy top 1 is thereby assembled.

How to Play

An example of how to play with the toy top 1 will now be described.

Figure 5:
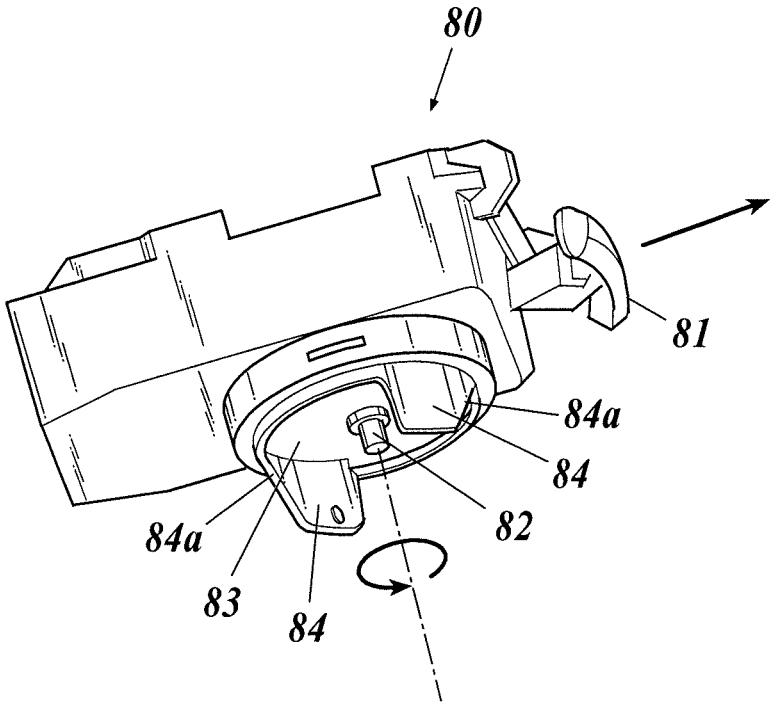
FIG. 5 is a perspective view of an exemplary launcher for spinning the toy top according to the embodiment.

FIG. 5 is a perspective view of an example launcher for spinning the toy top 1. FIGS. 6A and 6B illustrate the operation of the moving component 47 of the toy top 1 during play.

In this example, a player spins a toy top 1 to battle with an opponent toy top 1A (see FIG. 6B).

In such a case, a launcher 80 as illustrated in FIG. 5 is used to apply a rotary force to the toy top 1. The launcher 80 includes a disk (not shown) therein. The launcher 80 is configured such that when an operation member, e.g., a string or rack of teeth, (not shown) engages the disk and is pulled by a handle 81 while a spiral spring (not shown) biases the disk in a certain rotational direction, the disk is rotated, and a top holder 83 is rotated accordingly. The rotation of the top holder 83 is transmitted to the toy top 1 through forks 84 that protrude downward, so that the toy top 1 is rotated. Each fork 84 is inserted in one of the arc slits 46 of the body 40. When the handle 81 of the launcher 80 is completely pulled, the disk and the top holder 83 stop rotating while the toy top 1 continues rotating by the action of its inertial force. The toy top 1 accordingly moves away from the top holder 83 along tilted faces 84*a* of the forks 84.

In FIG. 5, the reference sign 82 denotes a rod that is retractable into the top holder 83. When the toy top 1 is loaded in the top holder 83, the rod 82 is pushed into the top holder 83 by the upper face of the toy top 1. Thus, the rod 82 can be used for detecting attachment/detachment of the toy top 1.

The toy top 1 thus launched spins in the clockwise direction in plan view in a predetermined playing field. When the body 40 of the toy top 1 collides with that of an opponent toy top 1A, the impact force or friction of the collision produces a reaction force that acts on the body 40 in the direction opposite to the spinning direction of the shaft portion 10 and the performance changing ring 30, and the body 40 thereby relatively turns in the direction opposite to the spinning direction of the shaft portion 10 and the performance changing ring 30.

Then, the ridges 21 mesh with the uneven portions 45 on the bottom face of the body 40 (see FIGS. 4A and 4B). The meshing position is changed every time the impact force of a collision acts to rotate the shaft portion 10 relative to the body 40. When the shaft portion 10 eventually reaches the engagement release position, the hooks 43 of the body 40 are released from the hooks 17 of the shaft portion 10, and the body 40 separates from the shaft portion 10 by the action of the biasing force of a spring (not shown) in the shaft portion 10 since the biasing force of the spring in the shaft portion 10 acts on the ridges 21. Accordingly, the toy top 1 is disassembled as illustrated in FIG. 1B.

The body 40 of the toy top 1 launched from the launcher 80 has an acceleration force by launching as illustrated in FIG. 6A. The acceleration force causes the moving component 47 in the outer peripheral portion to be shifted to an anticlockwise end in plan view of its movable range in the long hole 40*a*, where the anticlockwise end is opposite to the rotational direction of the toy top 1. In this case, an end in the rotational direction of the moving component 47 is shifted opposite to the rotational direction than an end in the rotational direction of the projection 41.

As illustrated in FIG. 6B, when the rotating (body 40 of the) toy top 1 collides with the opponent toy top 1A (illustrated by a double-dotted dashed line) in the state, an inertial force is applied to the body 40, and thereby the moving component 47 is clockwise moved in plan view in the rotational direction. The moving component 47 then collides with the opponent toy top 1A.

Alternatively, the moving component 47 moves to the end in the rotational direction of its movable range, and the boss 47*a* comes in contact with the inner peripheral face of the long hole 40*a* of the body 40 (otherwise, the respective clockwise ends in plan view of the moving component 47 and the projection 41*a* of the body 40 comes in contact with each other). An impact force caused by the contact is accordingly applied to the opponent toy top 1A.

The toy top 1 can launch a two-step attack to the opponent toy top 1A by the first impact force caused by a collision of the body 40, and a second impact force caused by a direct collision against the opponent toy top 1A or indirectly caused by a contact of the moving component 47 to the body 40 when the moving component 47 relatively moves in the rotational direction. The second step of the attack can be expected to be more powerful due to the relative movement of the moving component 47.

In particular, as illustrated in FIG. 6B, when the opponent toy top 1A collides with the projection 41*a* of the body 40 provided with the moving component 47 at the end in the rotational direction, an impact force is applied to the body 40 by the relative movement of the moving component 47. The impact force is then linearly applied to a position close to the collision point to the opponent toy top 1A. The impact force caused by the relative movement of the moving component 47 is more directly transmitted to the opponent toy top 1A without much distribution, and thereby a greater attacking effect can be achieved.

While embodiments of the present invention are described, it is not intended to limit the present invention to these embodiments, and a variety of modifications can be made without departing from the spirit of the present invention.

Figure 7:
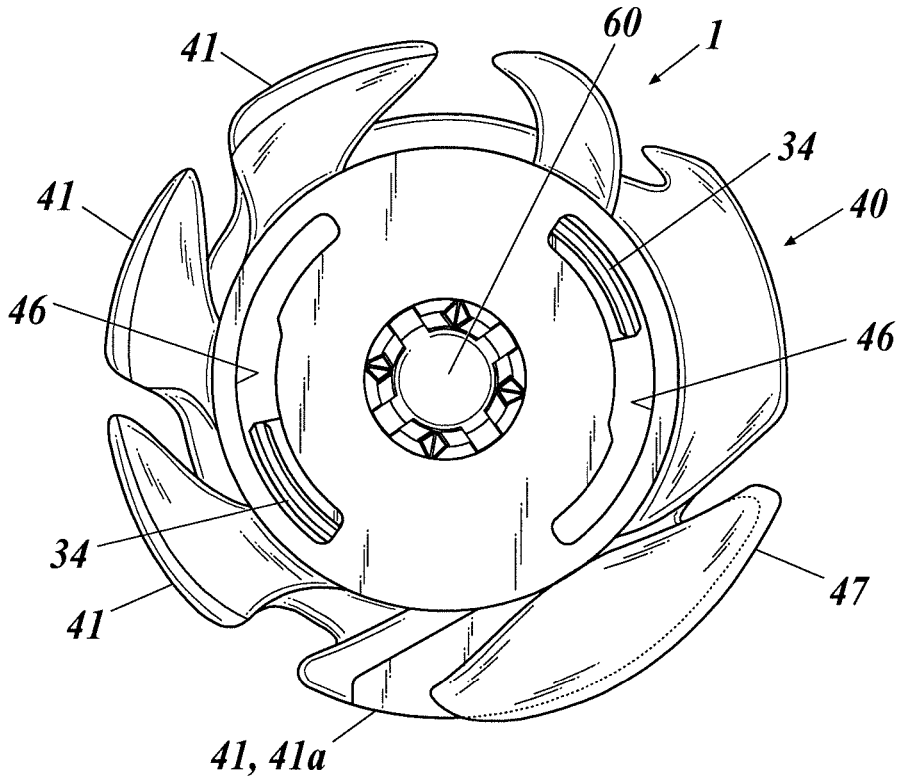
FIG. 7 illustrates a variation of the moving component according to another embodiment.

For example, in an embodiment described above, the moving component 47 is attached on the body 40 such that the outer peripheral face of the moving component 47 is substantially flush with that of the body 40 or disposed on a slightly inner periphery. Alternatively, the moving component 47 may be disposed on the body 40 so as to protrude to the outer periphery than the outer peripheral face of the body 40, as illustrated in FIG. 7.

During the rotation of the toy top 1 in such a configuration, not the body 40 but the moving component 47 may collide with the opponent toy top 1A. In this case, the moving component 47 colliding with the opponent toy top 1A moves relative to the body 40. The movement can accordingly absorb an impact caused by the collision.

The moving component 47 has only to be attached to the body 40 so as to be movable in a circumferential direction, and the mounting structure to the body 40 is not limited to that with a rivet. In the case that a fastener such as a rivet attaches the moving component 47 to the body 40, an increase in weight of the moving component 47 (weight of the component moving relative to the body 40) by the weight of the fastener can increase an impact effect caused by the relative movement of the moving component 47.

Also, the moving component 47 described above is attached to the top face of the projection 41*a* of the body 40. Alternatively, the moving component 47 may be disposed so as to be movable in the circumferential direction on the lateral face (outer peripheral face) of the projection 41*a*. The moving component 47 has only to be disposed in the outer peripheral portion (portion other than the central portion) of the body 40, and may be disposed on a portion other than the projection 41.

The number of the moving components 47 and their movable range should not be limited.

The entire disclosure of Japanese patent application No. 2017-022812 filed on Feb. 10, 2017, is incorporated herein by reference in its entirety.

What is claimed is:

1. A toy top comprising: a body having a central axis and a projection protruding radially outward relative to the axis to define an outermost peripheral portion of the body, wherein the body further has a component connected to the projection to be movable between first and second positions relative to the body within a predetermined range along a circumferential direction around the axis, wherein, the movably connected component has an outermost surface that, in at least one of the first or second positions, is flush with the outermost peripheral portion, and wherein the movably connected component includes a boss and a fastener which is fastened to the boss to connect the movably connected component to the projection.

2. The toy top according to claim 1, wherein the predetermined range is defined by an elongated opening formed in the projection between first and second ends and the movably connected component engages the opening, and wherein the first end is located in a rotational direction of the toy top and the second end is located opposite to the rotational direction.

3. The toy top according to claim 1, wherein the movably connected component moves so that the outermost surface of the movably connected component protrudes from the outermost peripheral portion.

4. The toy top according to claim 1, wherein the projection is a plurality of projections.

5. The toy top according to claim 4, wherein the movably connected component is a plurality of movably connected components, each being movably connected to one of the plurality of projections, respectively.

6. The toy top according to claim 1, wherein the movably connected component is positioned on an upper surface of the projection.

7. The toy top according to claim 1, wherein a thickness of the movably connected component is less than a thickness of the projection.

8. The toy top according to claim 1, wherein the predetermined range is defined by a hole formed in the projection, in which hole the boss moves from a first end of the hole to a second, opposite end of the hole.

9. The toy top according to claim 1, wherein the predetermined range is defined by one end of a hole formed in the projection in which the boss moves, to a wall of the projection opposite the one end.

10. The toy top according to claim 8, wherein, when the body is being rotated and a force is applied to the body, the movably connected component moves until the boss contacts the second, opposite end.

11. The toy top according to claim 9, wherein when the body is rotated and a force is applied to the body, the movably connected component moves until the movably connected component contacts the wall of the projection.

12. The toy top according to claim 1, wherein the movably connected component moves so that the outermost surface of the movably connected component is recessed from the outermost peripheral portion.

13. The toy top according to claim 1, wherein the movably connected component is positioned on a lower surface of the projection.

14. A toy top comprising:

a body having a central axis and a projecting portion protruding radially outward relative to the axis to define an outermost peripheral portion of the toy top; and a shaft portion coaxially connected to the body and upon which the toy top rotates, wherein the body further has a component connected to the projecting portion to be movable between first and second positions relative to the body within a predetermined range along a circumferential direction around the axis, wherein, the movably connected component has an outermost surface that, in at least one of the first or second positions, is flush with the outermost peripheral portion, and wherein the movably connected component is a plurality of movably connected components and the projecting portion is a plurality of projecting portions, and each of the movably connected components is movably connected to one of the plurality of projecting portions, respectively.

15. The toy top according to claim 14, wherein each of the plurality of movably connected components is movably connected to a respective projecting portion via a boss extending from the movably connected component through an elongated hole formed in the projecting portion.

16. A toy top comprising:

a body having a projection at an outer peripheral portion of the toy top, the projection protruding outward, wherein the body further has a movably connected component at the outer peripheral portion of the toy top, the movably connected component being connected to the projection to be movable between first and second positions relative to the body within a predetermined range along a circumferential direction around a rotational center of the toy top, and wherein the movably connected component includes a boss and a fastener which is fastened to the boss to connect the movably connected component to the projection.

17. The toy top according to claim 16, wherein the predetermined range is defined by a hole formed in the projection, in which hole the boss moves from a first end of the hole to a second, opposite end of the hole.

18. The toy top according to claim 16, wherein the predetermined range is defined by one end of a hole formed in the projection in which the boss moves, to a wall of the projection opposite the one end.

19. The toy top according to claim 17, wherein, when the body is being rotated and a force is applied to the body, the movably connected component moves until the boss contacts the second, opposite end.

20. The toy top according to claim 18, wherein when the body is rotated and a force is applied to the body, the movably connected component moves until the movably connected component contacts the wall of the projection.

21. A toy top comprising:

a body having a projecting portion at an outer peripheral portion of the toy top, the projecting portion protruding outward; and a shaft portion connected to the body and upon which the toy top rotates, wherein the body further has a movably connected component at the outer peripheral portion of the toy top, the movably connected component being connected to the projecting portion to be movable between a first position and a second position along a circumferential direction around a rotational center of the toy top, and wherein the movably connected component is movably connected to the projecting portion via a boss extending from the movably connected component through an elongated hole formed in the projecting portion.

22. A toy top comprising: a body having a central axis, and a projecting portion defining an outer peripheral portion of the toy top, the projecting portion protruding radially outward relative to the axis; and a shaft portion connected coaxially to the body and upon which the toy top rotates, wherein the body further has a movably connected component at the outer peripheral portion of the toy top, the movably connected component being directly connected to the projecting portion to be movable between a first position and a second position along a circumferential direction around the axis, wherein one of the first position or the second position is radially closer to the axis and the other of the first position or the second position is radially farther away from the axis, wherein the movably connected component is a plurality of movably connected components and the projecting portion is a plurality of projecting portions, and each of the plurality of movably connected components is movably connected to one of the plurality of projecting portions, respectively, and wherein one of the movably connected components and the projecting portions includes a projection, the other of the movably connected components and the projecting portions includes a recess and the projection is movably received in the recess to limit the movement of the movably connected components relative to the projecting portions between the first and second positions.

* * * * *